US007209288B2

(12) United States Patent
Wäntig et al.

(10) Patent No.: US 7,209,288 B2
(45) Date of Patent: Apr. 24, 2007

(54) SNORKEL DEVICE FOR A SUBMARINE

(75) Inventors: Ulrich Wäntig, Lübeck (DE); Michael Mente, Lübeck (DE); Wolfgang Scharf, Hoisdorf (DE); Christian Buck, Sereetz (DE)

(73) Assignee: Gabler Maschinenbau GmbH (DE)

( * ) Notice: Subject to any disclaimer, the term of this patent is extended or adjusted under 35 U.S.C. 154(b) by 97 days.

(21) Appl. No.: 10/785,272

(22) Filed: Feb. 24, 2004

(65) Prior Publication Data

US 2004/0169917 A1 Sep. 2, 2004

(30) Foreign Application Priority Data

Feb. 27, 2003 (DE) ..... 103 08 366

(51) Int. Cl.
*G02B 23/22* (2006.01)

(52) U.S. Cl. ..... 359/402; 114/327; 114/340; 359/406

(58) Field of Classification Search ..... 359/402–403, 359/405–406, 895; 114/340
See application file for complete search history.

(56) References Cited

U.S. PATENT DOCUMENTS

| | | | | |
|---|---|---|---|---|
| 726,947 | A * | 5/1903 | Lake | 114/334 |
| 2,413,350 | A * | 12/1946 | Helmore | 114/21.1 |
| 3,863,584 | A * | 2/1975 | Wilkins | 114/334 |
| 4,436,051 | A | 3/1984 | Nollez et al. | 114/340 |
| 4,447,129 | A * | 5/1984 | Barthelat et al. | 359/872 |
| 4,611,551 | A * | 9/1986 | Ferguson et al. | 114/339 |
| 4,848,886 | A * | 7/1989 | Pratt | 359/406 |
| 5,634,424 | A * | 6/1997 | Ortelli | 114/339 |
| 6,002,648 | A * | 12/1999 | Ambs | 367/159 |
| 6,269,763 | B1 * | 8/2001 | Woodland | 114/382 |

FOREIGN PATENT DOCUMENTS

| | | | |
|---|---|---|---|
| DE | 3637618 | A * | 5/1988 |
| DE | 37 37 342 | | 5/1989 |
| DE | 90 10 980.5 | | 12/1990 |
| EP | 0 325 775 | | 8/1989 |
| EP | 0 372 265 | | 6/1990 |
| EP | 1162137 | A2 * | 12/2001 |
| GB | 2014 | | 0/1914 |
| GB | 17404 | | 0/1913 |
| GB | 2 012 217 | A * | 7/1979 |

* cited by examiner

*Primary Examiner*—Drew A. Dunn
*Assistant Examiner*—Lee Fineman
(74) *Attorney, Agent, or Firm*—McGlew & Tuttle, PC

(57) ABSTRACT

An optical observation device is connected to an extendable and retractable snorkel tube for above-water observation during the snorkel travel (travel at periscope depth) of the submarine. The optical observation device is designed as a compact unit which consists of an optronics unit with a short-travel drive. The compact unit is assembled on the snorkel tube. At least one further compact unit is provided which comprises at least one communication arrangement with a short-travel drive, wherein this further compact unit is likewise provided on the snorkel tube.

21 Claims, 5 Drawing Sheets

Fig. 7
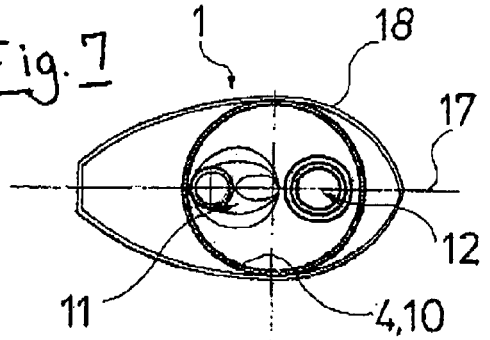
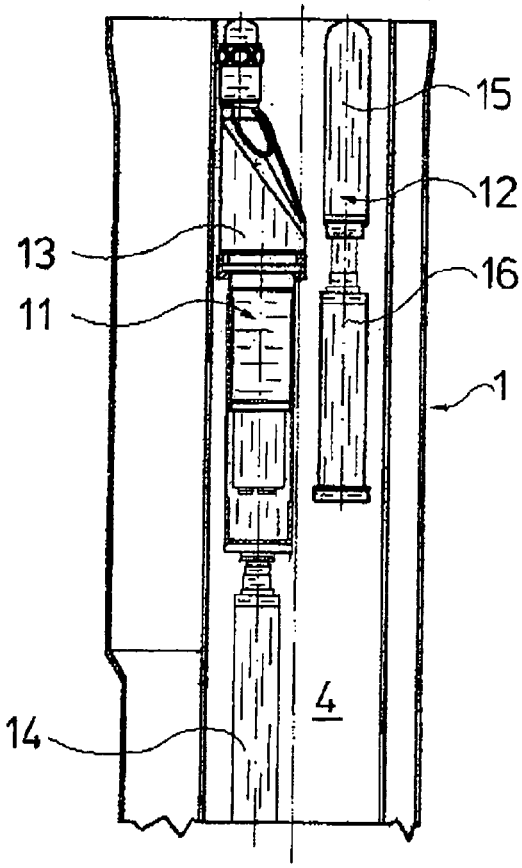
Fig. 8
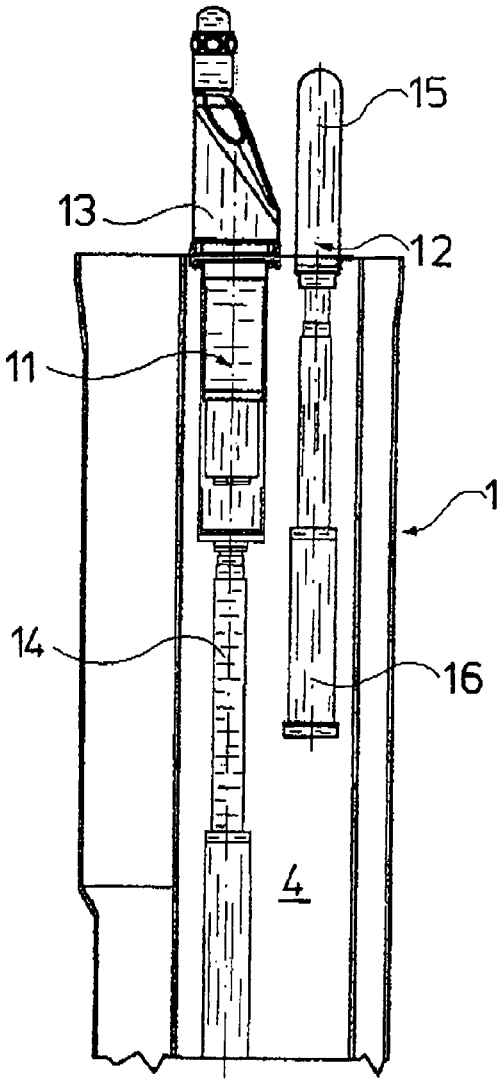
Fig. 9

SNORKEL DEVICE FOR A SUBMARINE

CROSS REFERENCE TO RELATED APPLICATIONS

This application claims the benefit of priority under 35 U.S.C. § 119 of German patent application DE 103 08 366.9 filed Feb. 27, 2003 the entire contents of which are incorporated herein by reference.

FIELD OF THE INVENTION

The invention relates to a snorkel for a submarine, and in particular to a snorkel device with optical and communication units.

BACKGROUND OF THE INVENTION

A snorkel device for a submarine is known where the snorkel tube is able to be extended out of the tower of the submarine and retracted again. An optical periscope is assembled in a guided manner in order to observe the sea region above the water during the submerged travel of the submarine carried out at the so-called periscope depth (snorkel travel with which the snorkel tube is extended with the periscope). It is furthermore necessary to separately extend an antenna mast with an antenna means in order to permit communication, in particular radio communication, with other communication participants at sea. For this, the respective antenna is arranged at the upper end of a long mast which is extended out of the tower of the submarine by way of a long-travel cylinder, and is retracted again after the radio communication has been effected.

If the snorkel and the antenna means or several antenna means are extended, the speed of the submarine is reduced on account of the considerably increased resistance of the water on all the extended apparatus, by which means in turn the fuel consumption for the combustion motor drive of the submarine increases. Furthermore if the snorkel with the periscope and one or more antenna masts are extended, a large so-called signature, i.e. a white water tail of water foam and sea spray in the form of a bow wave are formed trailing on the surface of the sea from the extended apparatus, which is or are very easy to recognize and therefore permits an unambiguous, but undesirable location of the submarine. A mutual hindrance of the functioning is also the case when several antenna masts are extended. This is particularly the case with the periscope, whose viewing function is limited by the extended masts.

Furthermore by way of combined construction of the snorkel and the periscope extending axially in the inside of the snorkel and guided through the pressure hull of the submarine, only a limited positioning of the periscope is possible with regard to space, i.e. in particular of its lower end in the inside of the submarine. Furthermore the periscope may only be used in its completely extended condition because its viewing optics which are provided at the lower end of the periscope are only then located at the eye height of the operating persons concerned.

BRIEF SUMMARY OF THE INVENTION

The object of the invention lies in the improvement of a snorkel device of the initially mentioned type for a submarine, which given a compact and economical construction, permits communication with other marine participants, and provide low locatability of the submarine.

The solution of this object is a snorkel device for a submarine, wherein the snorkel device comprises an extendible and retractable snorkel tube and an optical means connected to the snorkel tube, for above-water observation during snorkeling travel (travel at periscope depth) of the submarine, wherein the optical observation means is formed as a compact unit which comprises an optronics unit and a short-travel drive for this, and wherein at least one further compact unit is provided which comprises at least one communications means and a short-travel drive for this. These compact units are provided on the extendible and retractable snorkel tube.

The advantages which are achieved with the invention lie particularly in the fact that on account of the compact units in the form of optronics drivable with a short travel, and in the form of at least one communication means, in particular for radio communication, which is drivable with a short travel, which are assembled on the extendible snorkel tube of the snorkel device, a very compact and space-saving construction manner for a submarine snorkel device is created, in comparison to antenna masts drivable with a long travel and positioned separately to the snorkel tube at a certain distance to this. This snorkel device apart from having the known snorkel function also allows the hindrance-free observation or only insignificantly hinders the observation of the sea region around the submarine, and additionally permits the participation in radio communication. Since the optronics and the respective radio units are located directly on the snorkel tube, there furthermore results an overall significantly lower flow resistance given an extended snorkel, which minimizes the reduction in the traveling speed of the submarine and thus effects a saving in fuel for the combustion motor of the submarine. Logically, a relatively small signature arises, by which means the locatability of the submarine is made considerably more difficult. One may furthermore exploit the full cross section of the snorkel system for the supply of fresh air.

An economical construction manner is also achieved in that the travel drives for the optronics and radio antennae may be small and short since the optronics and radio antennae, because they are fastened to the snorkel, may firstly be displaced indirectly with the help of the travel drive of the snorkel. Only if the snorkel, i.e. its extendible and retractable tube has been extended into its desired operating position, which with regard to its maximal travel may also be an intermediate position, are the short-travel drives actuated so that the optics and radio antenna are then moved into their working position, which likewise may be an intermediate position. A further advantage of the invention lies in the fact that the operational readiness of the optronics and antennae may be reached considerably more quickly since only short-travel paths need to be covered for extending these functional apparatus. Due to the travel paths which are to be covered in a short and quick manner, the viewing impediment to the optronics caused by the antennae is minimized. The use of the optronics furthermore permits the operating position in the inside of the submarine for the person observing the monitor allocated to the optronics to be able to be optimally selected with regard to his position.

A yet further advantage of the invention lies in the fact that the usual redundancy of the previously mentioned apparatus for optical observation and communication as well as for obtaining information in the tower of the submarine may be further ensured in an improved manner since due to the compact construction of the snorkel device according to the invention, one achieves a gain in space in the tower of the submarine which may be used for other apparatus and/or for more persons in the tower.

One advantageous design of the snorkel device according to the invention lies in the fact that the individual compact units are assembled on the outside of the extendible and retractable snorkel tube of the snorkel, and that the compact units and the snorkel tube carrying these compact units are surrounded by a common streamlined casing. In a further design the short-travel drives consists of hydraulic cylinder drives. The advantages of the invention which are mentioned further above are further optimized with such a design.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 7 is a view from above of;

FIG. 8 is a longitudinal section through another embodiment example in the retracted condition;

FIG. 9 is an embodiment example according to FIG. 8 in the extended condition;

DETAILED DESCRIPTION OF THE INVENTION

Figure 1:
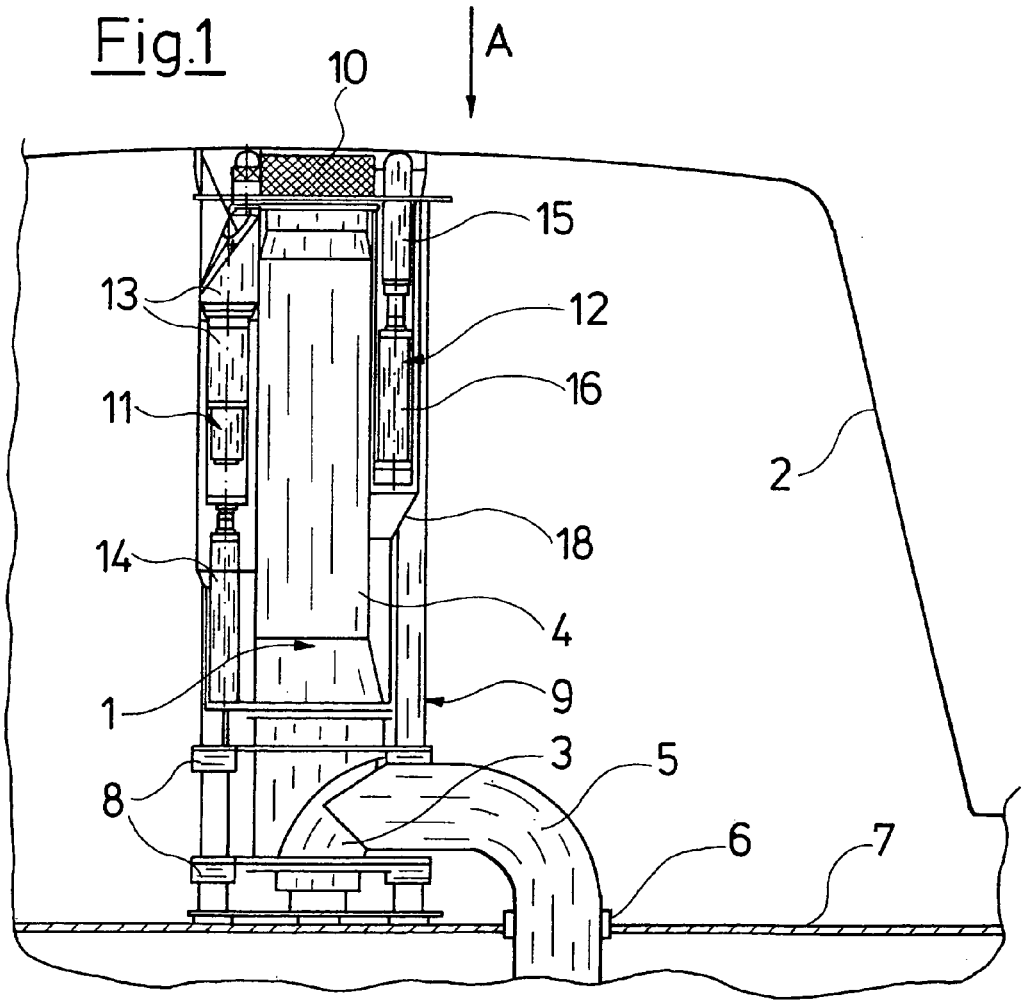
FIG. 1 is a longitudinal section through the embodiment example in the retracted condition.

The embodiment example according to FIG. 1 contains a snorkel indicated generally at 1 which is usually provided in the tower 2 of the submarine which is not represented any further. The snorkel 1 comprises a stationary tube 3, a vertically displaceable movable tube 4 surrounding this tube, as well as a further stationary tube 5 which on its one end is connected to the stationary tube 3 and on its other end is led into the inside of the submarine via a so-called bushing [lead-through] 6 of the pressure hull 7 of the submarine. The bottom end of the movable snorkel tube 4 is mounted on a rail 8 which in turn slides on a usual vertical column guide 9. A usual cylinder travel drive (not shown) engages on the rail 8 in order to vertically displace the snorkel tube 4. This cylinder travel drive is usually likewise installed in the tower 2. The movable snorkel tube 4 surrounds the first stationary tube 3 so that the snorkel tube 4 is telescopically extendible and retractable. The top end of the movable snorkel tube 4 is provided with a protective cage 10 and with a usual closure mechanism (not shown) in order to prevent the undesired penetration of water and objects. The snorkel 1 serves for the fresh air supply of the submarine and may further be designed such that the exhaust gases of the combustion motor drive of the submarine may be led away to the atmosphere.

The movable snorkel tube 4 on its outer side is preferably provided with at least two compact units 11 and 12. The one compact unit 11 consists of an optronics unit 13 and a travel drive 14. The optronics unit 13 is designed in a conventional manner and in its extended condition serves for the optical observation of the sea region whilst the submarine is located at its so-called snorkeling depth (travel at periscope depth), at which the snorkel 1 is extended into the desired position, which as a rule is the upper end position of the snorkel tube 4. The optronics unit converts the optically perceived image into electrical signals which in the usual manner are led via cable leads (not shown) into the inside of the submarine to the monitor present here and then converted back again so tat the operating person may observe the image perceived with the help of the optronics unit 13 on the monitor.

The travel drive 14 is preferably a hydraulic cylinder drive whose travel cylinder is of a relatively short construction type, since the optronics unit only needs to cover a short travel path in order to be able to be displaced beyond the top end of the movable snorkel tube 4 into its uppermost functional position, since the travel movement of the optronics unit 13 is firstly effected by the travel drive of the snorkel tube 4.

The further compact unit 12 of the movable snorkel tube 4 comprises a communication means 15 and a travel drive 16.

This communication means 15 is preferably a radio unit for the information exchange during the snorkeling (travel at periscope depth) of the submarine. The radio unit may be set up for HF, VHF, UHF or UHF-satcom radio communication. At the same time it becomes possible for the radio unit to also have a combination of the radio antennae concerned. In this case too the electrical radio signals are led further via cable leads (not shown) into the inside of the submarine to the desired locations and are processed here in order to carry out the radio communication. The respective radio unit is equipped with a suitable receiver and transmitter antenna.

The travel drive 16 for the previously mentioned radio unit likewise is preferably a hydraulic cylinder drive whose cylinder is likewise designed relatively short since this drive likewise only needs to cover a short travel path in order to be able to be brought into its functional position.

Figure 3:
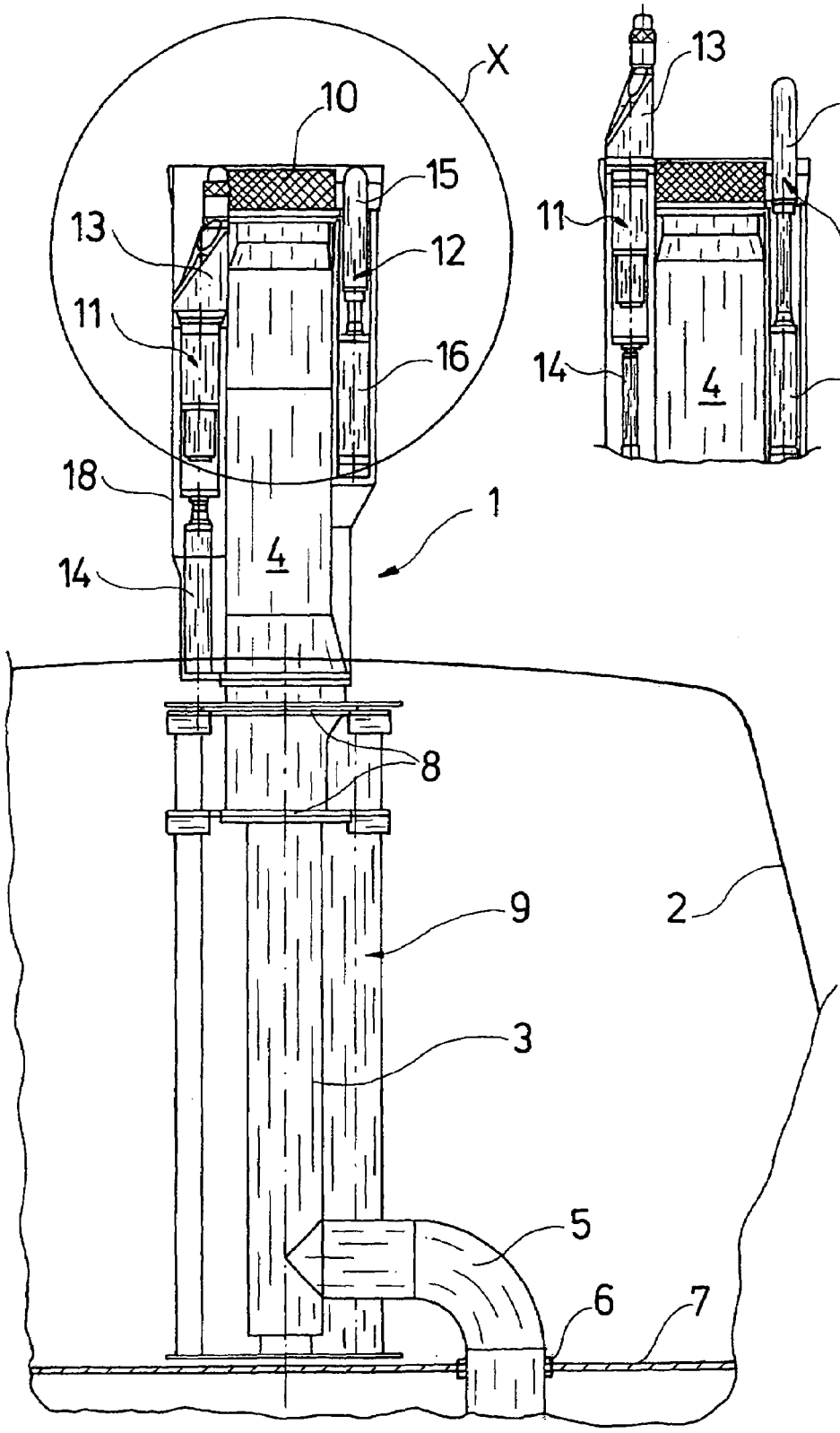
FIG. 3 is an embodiment example according to FIG. 1 in the extended condition.
Figure 4:
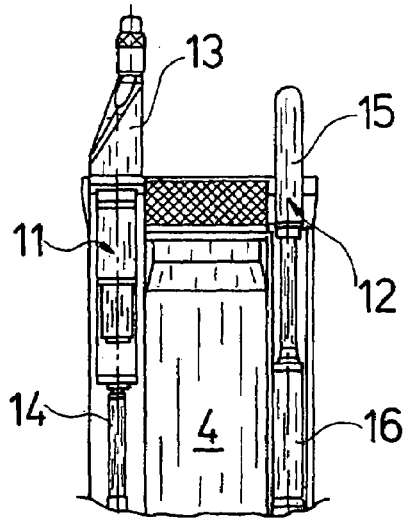
FIG. 4 is a view of the detail X in FIG. 3.

The FIGS. 3 and 4 show the snorkel 1 as well as the two compact units 11 and 12 fastened on its extended snorkel tube 4, in each case with the snorkel in the fully extended functional position. One recognizes in FIG. 4 that the optronics unit 13 and the communication means 15 are in each case located above the upper end of the extended snorkel tube 4. At the same time the optronics unit 13 assumes a higher position so that the optical observation of the sea region is not inhibited by the communication means 15. One may further recognize from FIGS. 3 and 4 that the optronics units 13 and the communication means 15 may be moved to their functional position, and again retracted from this within a short time, so that the operational readiness of the optronics unit 13 and/or the communication means 15 is ensured in a very short time.

At least one further contact unit may be provided additionally to the two compact units 11 and 12. These further compact units may likewise be a radio unit which is equipped with at least one of the previously mentioned radio antenna. As a rule one proceeds in that one applies a radio antenna which differs from the radio antenna of the other communication means. It is however also possible to use two communication means 15 with in each case the same radio antenna if a redundancy of these compact units is required. An apparatus redundancy may however also be ensured in that a similar-type radio unit may be used in the conventional manner, i.e. an extending apparatus with a long travel which additionally to the previously described snorkel unit 1 is arranged at a distance thereto in the tower.

Additionally or alternatively to the mentioned further compact unit or units 12 one may also provide at least one other further compact unit (not shown) which uses an information means in the form of a GPS unit (global positioning system) or in the form of a ESM (electronic support measures) unit. These information systems too may be driven in a short-travel manner as explained so that in this case too a relatively short hydraulic cylinder drive is provided. With regard to the construction in this case too one may proceed in that a single other further compact unit is provided which contains both previously mentioned information means. In this manner the procurement of information may be effected by way of satellite and/or radar and may be taken into account for submarine navigation.

Figure 2:
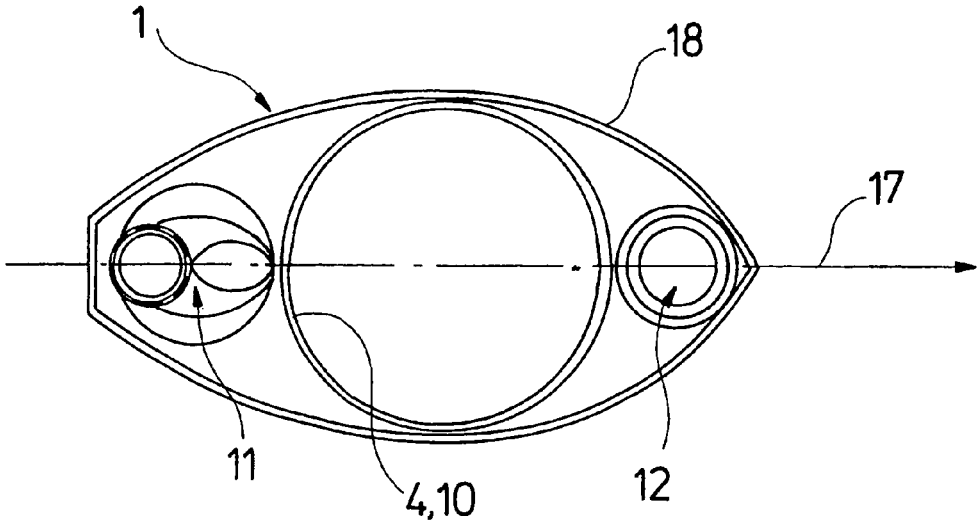
FIG. 2 is a view from above according to arrow A in FIG. 1.

With regard to the spatial conditions around the vertically moveable snorkel tube 4 and to the desired demands on the communication and information procurement of the submarine concerned, it is the case of how many compact units are used additionally to the optronic compact unit on the snorkel tube 4. In FIG. 2 in which two compact units 11 and 12 are represented, one may recognize that there is still space for further compact units, particularly as the diametrical constructional size of these units is of course different and may have a small construction size.

Figure 5:
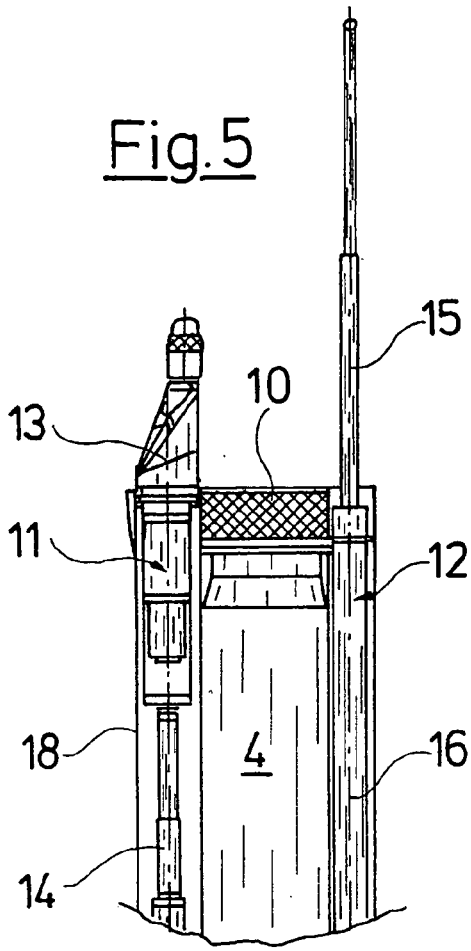
FIG. 5 is a modified embodiment example in the extended condition.
Figure 6:
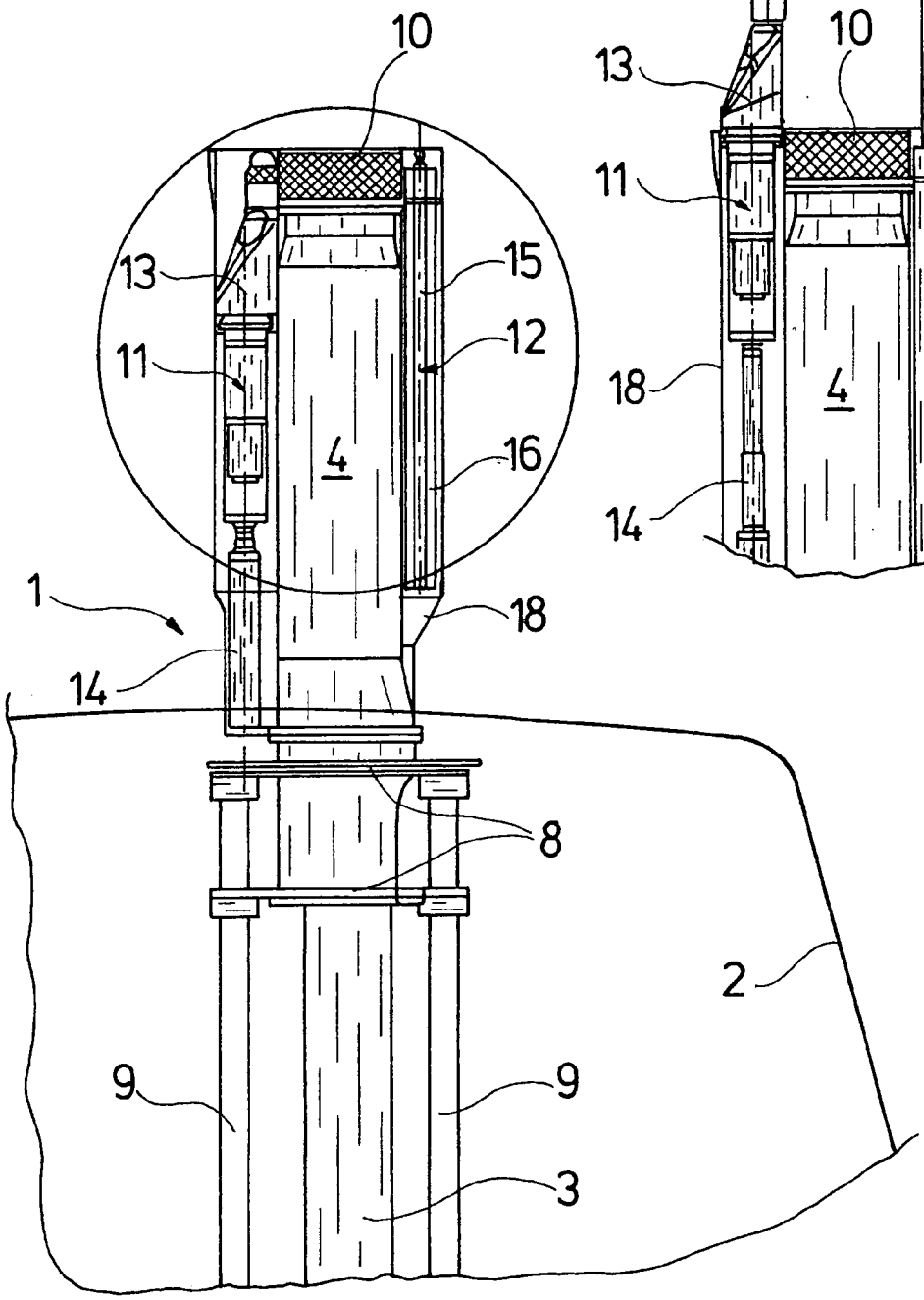
FIG. 6 is a view of the detail Y in FIG. 5.

From FIGS. 1, 3 and 5 one may recognize that the compact units 11 and 12 are assembled outside the snorkel tube 4. These compact units are practically fastened without any distance to the snorkel tube 4, and with regard to the travel direction of the submarine indicated by arrow 17 are arranged behind one another in a manner such that the one compact unit 12 is located in front of the snorkel tube 4 and the other compact unit 11 is located behind the snorkel tube 4. It is to be understood that the parts 4, 11 and 12 are arranged in such a manner to only produce a small signature which is determined essentially by the snorkel tube 4. For further minimizing the signature one may also proceed in that a streamlined casing 18 is provided, as FIG. 2 shows. This casing 18, seen in cross section, is formed approximately ovally and surrounds the compact units 11 and 12 as well as the snorkel tube 4 carrying these compact units.

Figure 10:
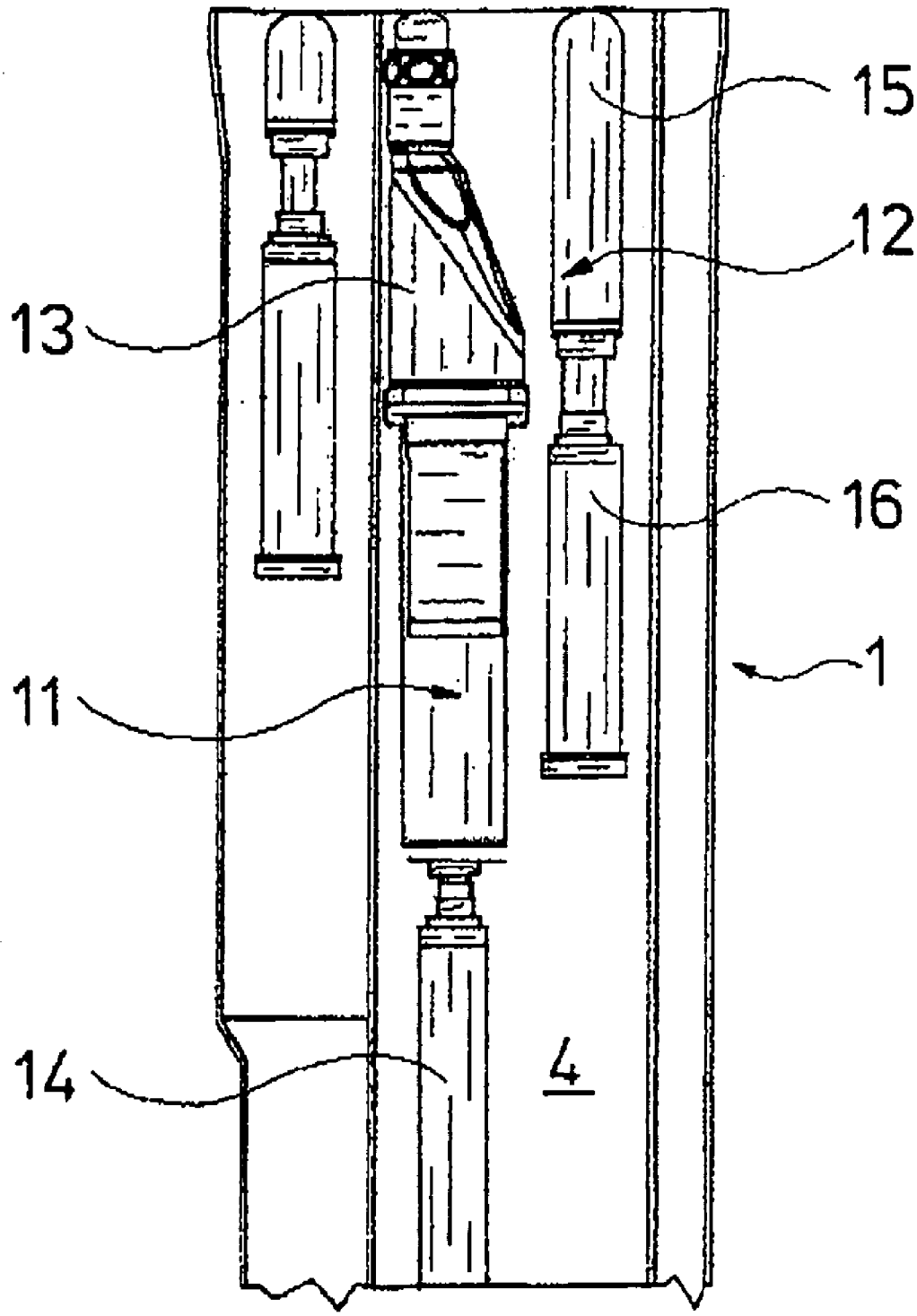
FIG. 10 is a longitudinal section through yet another embodiment example in the retracted condition.

As the FIGS. 1 to 6 show, the compact units 11, 12 are provided outside the snorkel tube 4. They may also be provided within the snorkel tube as shown in FIGS. 8–10, wherein the snorkel tube is ten someWhat larger in diameter. If the compact units are provided on the inner side of the snorkel tube it is advantageous for this snorkel tube itself to be designed in a streamlined manner (as shown in FIG. 7) e.g. roughly ovally. In this case it may be alternatively advantageous to design only the region of the retractable and extendible snorkel tube 4 which points in the travel direction in a streamlined manner. With this partly streamlined design of the tube 4, the front compact unit 12 is located within the snorkel tube 4 and the rear compact unit 11 outside the snorkel tube. The same also applies to several front and rear compact units.

While specific embodiments of the invention have been shown and described in detail to illustrate the application of the principles of the invention, it will be understood that the invention may be embodied otherwise without departing from such principles.

What is claimed is:

1. A snorkel device for a submarine having a pressure hull, wherein the snorkel device comprises:

a telescopically movable snorkel tube including a telescopically movable structure connected to an outside of said pressure hull for extending and retracting an end thereof;

an optical observation means connected to said snorkel tube, for above-water observation during submarine travel at periscope depth, wherein said optical observation means is formed as a compact unit which comprises an optronics unit and a short-travel drive; and at least one further compact unit comprising at least one communications means and another short-travel drive, and wherein optical observation means compact unit and communications means further compact unit are provided on said telescopically movable snorkel tube.

2. A snorkel device according to claim 1, wherein said optical observation means compact unit and said at least one further compact unit are provided on one of an outer side and an inner side of said snorkel tube, said snorkel tube being extendable and retractable.

3. A snorkel device according to claim 2, further comprising:

a common streamlined casing, wherein said optical observation means compact unit and said at least one further compact unit are provided on said outer side of said snorkel tube and said common, streamlined casing is arranged around said snorkel tube and said compact units.

4. A snorkel device according to claim 3, wherein said short-travel drives of said optical observation means compact unit and said at least one further compact unit include hydraulic cylinder drives.

5. A snorkel device according to claim 4, further comprising:

another compact unit including an information means driven in a short-travel manner, said information means including one of a GPS unit and an ESM unit.

6. A snorkel device according to claim 5, wherein said communication means includes a radio unit for HF, VHF, UHF or UHF-satcom radio communication or a combination thereof.

7. A snorkel device according to claim 3, wherein said communication means includes a radio unit for HF, VHF, UHF or UHF-satcom radio communication or a combination thereof.

8. A snorkel device according to claim 2, wherein said optical observation means compact unit and said at least one further compact unit are provided on said inner side of said snorkel tube; said snorkel tube itself being at least partly designed in a streamlined manner.

9. A snorkel device according to claim 8, wherein said short-travel drives of said optical observation means compact unit and said at least one further compact unit include hydraulic cylinder drives.

10. A snorkel device according to claim 9, further comprising:

another compact unit including an information means driven in a short-travel manner, said information means including one of a GPS unit and an ESM unit.

11. A snorkel device according to claim 10, wherein said communication means includes a radio unit for HF, VHF, UHF or UHF-satcom radio communication or a combination thereof.

12. A snorkel device according to claim 8, wherein said communication means includes a radio unit for HF, VHF, UHF or UHF-satcom radio communication or a combination thereof.

13. A snorkel device according to claim 2, wherein said short-travel drives of said optical observation means compact unit and said at least one further compact unit include hydraulic cylinder drives.

14. A snorkel device according to claim 2, wherein said communication means includes a radio unit for HF, VHF, UHF or UHF-satcom radio communication or a combination thereof.

15. A snorkel device according to claim 2, further comprising:

another compact unit including an information means driven in a short-travel manner, said information means including one of a GPS unit and an ESM unit.

16. A snorkel device according to claim 1, wherein said short-travel drives of said optical observation means compact unit and said at least one further compact unit include hydraulic cylinder drives.

17. A snorkel device according to claim 16, wherein said communication means includes a radio unit for HF, VHF, UHF or UHF-satcom radio communication or a combination thereof.

18. A snorkel device according to claim 1, wherein said communication means includes a radio unit for high frequency (HF), very high frequency (VHF), ultra high frequency (UHF) or UHF-satcom radio communication or a combination thereof.

19. A snorkel device according to claim 1, further comprising:

another compact unit including an information means driven in a short-travel manner, said information means including one of a GPS unit and an ESM unit.

20. A snorkel device for a submarine having a pressure hull having a pressure space, the device comprising:

a movable snorkel tube movably connected to the submarine pressure hull and movable away from the submarine, said snorkel tube mounted outside of said pressure space;

at least one stationary tube located within said snorkel tube in a non-operating position;

a vertical guiding rail;

a rail connected to bottom of said snorkel tube, said rail slidably mounted to said vertical guiding rail;

a driving means for engaging said rail, said rail telescopically extending said snorkel tube relative to at least one stationary tube to an operating position;

an optical device connected to said snorkel tube in a retracted position, said optical device comprising an optronics short-travel drive connected to said snorkel tube for moving said optical device relative to said snorkel tube and an optronics unit for above-water observation during travel of the submarine at periscope depth, said optronics short-travel drive moving said optronics unit relative to said snorkel tube to an extended position with said optronics unit arranged beyond an end of said snorkel tube; and a communication arrangement connected to said snorkel tube in another retracted position, said communication arrangement comprising a communications short-travel drive connected to said snorkel tube for moving said communications arrangement relative to said snorkel tube and a communications unit for above-water communication during travel of the submarine at periscope depth, said communications short-travel drive moving said communications unit relative to said snorkel tube to another extended position with said communications unit arranged beyond said end of said snorkel tube.

21. A snorkel device according to claim 20, wherein said optical device and said communication arrangement are retracted within said snorkel tube in a non-operating state.

* * * * *